United States Patent [19]

Imai et al.

[11] Patent Number: 4,906,964

[45] Date of Patent: Mar. 6, 1990

[54] VOLTAGE NON-LINEAR RESISTOR

[75] Inventors: Osamu Imai, Kasugai; Ritsu Sato, Nagoya, both of Japan

[73] Assignee: NGK Insulators, Ltd., Nagoya, Japan

[21] Appl. No.: 319,108

[22] Filed: Mar. 6, 1989

[30] Foreign Application Priority Data

Mar. 10, 1988 [JP] Japan ..... 63-54748

[51] Int. Cl.[4] ..... H01C 7/10

[52] U.S. Cl. ..... 338/21

[58] Field of Search ..... 338/21, 20; 361/117, 361/118, 119, 127, 128

[56] References Cited

U.S. PATENT DOCUMENTS 4,041,436 8/1977 Rouchich et al. ..... 338/21

4,042,535 8/1977 May ..... 338/21 X

*Primary Examiner*—Bruce A. Reynolds

*Assistant Examiner*—M. M. Lateef

*Attorney, Agent, or Firm*—Arnold, White & Durkee

[57] ABSTRACT

An improved voltage non-linear sintered resistor which includes zinc oxide, bismuth oxide and at least one metal oxide additive selected from the group consisting of antimony oxide, silicon oxide, and mixtures thereof. The sintered resistor includes at least two crystalline phases including $\alpha$ and $\delta$ crystalline phases of bismuth oxide and has a quantity ratio of $\alpha/\delta$ crystalline phases of bismuth oxide of about 0.1–0.8.

1 Claim, No Drawings

VOLTAGE NON-LINEAR RESISTOR

BACKGROUND OF THE INVENTION

1. Field of the Invention

The present invention relates to a voltage non-linear resistor consisting essentially of zinc oxide.

2. Related Art Statement

Heretofore, resistors consisting essentially of zinc oxide and containing a small amount of an additive, such as $Bi_2O_3$, $Sb_2O_3$, $SiO_2$, $Co_2O_3$, or $MnO_2$, etc., have been widely known as superior voltage non-linear resistors, and have been used as arrestors or the like using such characteristic property.

Among such additives, bismuth oxide has $\alpha$, $\beta$, $\gamma$ and $\delta$ type crystal phase, but a bismuth oxide in conventional zinc oxide element is usually only $\beta$ phase, $\gamma$ phase or $\beta+\gamma$ phase.

Crystal phases of bismuth oxide in the zinc oxide element have large influences on characteristics of the varistor, so that optimum crystal phases have to be used. If $\beta$ phase is only used, the life performance against applied voltage becomes short and discharge current withstanding capability is decreased. While, if $\gamma$ phase is only used, current leakage becomes large, the index $\alpha$ of voltage non-lineality becomes small, and electrical insulation resistance also becomes low. If $\beta+\gamma$ phase is only adopted, a mutual ratio of $\beta$ and $\gamma$ relative to each other is unstable and constant characteristic properties can not be obtained.

SUMMARY OF THE INVENTION

An object of the present invention is to obviate the above drawbacks.

Another object of the present invention is to provide a voltage non-linear resistor having an improved discharge current withstanding capability, improved varistors characteristics, and small variations of various characteristic properties.

Now, the above objects can be achieved by the present invention.

The present invention is a voltage non-linear resistor consisting essentially of zinc oxide and containing at least one metal oxide, such as bismuth oxide, antimony oxide, silicon oxide, or mixtures thereof etc., as an additive, comprising at least two phases of $\alpha$ and $\gamma$ type crystal phases of bismuth oxide, and a quantity ratio $\alpha/\gamma$ of an amount of the $\alpha$ type crystal phase and an amount of the $\gamma$ type crystal phase being 0.1–0.8.

Because the resistor of the above constitution contains at least a desired amount ratio of $\alpha$ type crystal phase and $\gamma$ type crystal phase as the crystal phases of bismuth oxide in the resistor, a voltage non-linear resistor can be obtained having an improved discharge current withstanding capability, and improved varistor characteristics, and not having variation of various characteristic properties.

The reason of limiting the amount ratio of $\alpha/\gamma$ to 0.1–0.8 is because if $\alpha/\gamma$ is less than 0.1, the characteristic property of the varistor at a low current region is deteriorated and the electrical insulation resistance is widely decreased. While if $\alpha/\gamma$ exceeds 0.8, the lightening discharge current withstanding capability is decreased and the life performance against applied voltage also becomes bad. From a viewpoint of the lightening discharge current withstanding capability, $\alpha/\gamma$ is preferably 0.2–0.5

For incorporating at least the desired amount ratio of $\alpha$ type and $\gamma$ type crystal phases of bismuth oxide, preferably silicon oxide in the form of amorphous silicon is added in an amount of 7–11 mol % calculated as $SiO_2$ relative to zinc oxide, the sintering is effected at a relatively low temperature of 1,050°–1,200° C., and insulative covering of the side glass of the resistor is heat-treated at a temperature of 450°–550° C. More preferably, a portion or the whole of the components of the additives including $SiO_2$ is calcined to 700°–1,000° C. in advance, adjusted as predetermined, mixed with zinc oxide, and then sintered.

If the silica component is crystalline, reactivity thereof with zinc oxide becomes bad, formed zinc silicates are not distributed uniformly, and the discharge current withstanding capability apts to decrease, so that the use of amorphous silica is preferable.

If the addition amount of $SiO_2$ is less than 7 mol %, the aimed $\gamma$ phase of bismuth oxide is difficult to obtain. While, if the amount exceeds 11 mol %, crystal phase of zinc silicate ($Zn_2SO_4$) increases too much and the discharge current, withstanding capability is likely to deteriorated.

If the sintering temperature is less than 1,050° C., a sufficiently dense sintered body is hard to obtain. While if it exceeds 1,200° C., the pores are increased so much that a good sintered body is difficult to obtain.

If the heat-treating temperature of the side glass is less than 450° C., the aimed $\gamma$ phase is hard to obtain. While if it exceeds 550° C., all $\alpha$ phase is transformed into $\gamma$ phase.

The components of the additives including $SiO_2$ are preferably calcined at 700°–1,000° C., because such calcination prevents gelation of a slurry of mixed raw materials of the resistor, and affords a uniform distribution of the small amounts of the additives in the resistor.

In producing the present voltage non-linear resistor consisting essentially of zinc oxide, at first, a raw material of zinc oxide adjusted as predetermined, and a raw material of an additive selected from the group consisting of bismuth oxide, cobalt oxide, manganese oxide, antimony oxide, chromium oxide, silicon oxide, nickel oxide, boron oxide, silver oxide, or mixtures thereof, etc., and adjusted to a desired fineness, are mixed in desired amounts. In this case, instead of silver oxide or boron oxide, silver nitrate or boric acid may be used, preferably bismuth borosilicate glass containing silver may be used. In this case, preferably $SiO_2$ is amorphous silica, and used in an amount of 7–11 mol % relative to zinc oxide. Preferably, an additive including the amorphous silica is calcined at 700°–1,000° C., adjusted as predetermined, and mixed with zinc oxide in desired amounts.

The powders of these raw materials are added and mixed with a desired amount of an aqueous solution of polyvinyl alcohol, etc., as a binder, and preferably with a desired amount of a solution of aluminum nitrate as a source of aluminum oxide. The mixing operation is effected preferably in a dispersant mill to obtain a mixed slurry. The mixed slurry thus obtained is granulated preferably by a spray dryer to obtain granulates. After the granulation, the granulates are shaped into a desired form under a forming pressure of 800–1,000 kg/cm$^2$. The formed body is calcined up to 800°–1,000° C., at a temperature heating and cooling rate of 50°–70° C./hr, for 1–5 hrs to flow away and remove the binder.

Next, an insulative covering layer is formed on the calcined body at the side surface thereof. In an embodiment of the present invention, a paste of desired amounts of oxides, such as $Bi_2O_3$, $Sb_2O_3$, ZnO, $SiO_2$, or the mixtures thereof, etc., added and mixed with an organic binder, such as ethyl cellulose, butyl carbitol, n-butyl acetate, or the mixtures thereof, etc., is applied on side surface of the calcined body to a thickness of 60–300 μm. In this case also, preferably amorphous silica is used as the silica component. The calcined body applied with the paste is sintered up to 1,000°–1,300° C., preferably 1,050°–1,200° C., at a temperature heating and cooling rate of 40°–60° C./hr, for 3–7 hrs to form a glassy layer. In a preferred embodiment, a glass paste of a glass powder in an organic binder, such as ethyl cellulose, butyl carbitol, n-butyl acetate, etc., is applied on the insulative covering layer to a thickness of 100–300 μm, and heat treated in air up to 450°–550° C., at a temperature heating and cooling rate of 100°–200° C./hr, for 0.5–2 hrs to form a glass layer.

Afterwards, both the top and bottom flat surfaces of the disklike voltage non-linear resistor thus obtained is polished by SiC, $Al_2O_3$, diamond or the like polishing agent corresponding to #400–2,000, using water or preferably an oil as a polishing liquid. Then, the polished surfaces are rinsed, and provided with an electrode material, such as aluminum, etc., over the entire polished end surfaces by means of a metallizing, for example, so as to form electrodes at the polished end surfaces thereby to obtain a voltage non-linear resistor.

The electrodes are preferably formed on the end surfaces about 0.5–1.5 mm inner from the circumferential end thereof.

DESCRIPTION OF PREFERRED EMBODIMENTS

According to the aforementioned method, a composition of raw materials consisting of 0.1–2.0 mol % of $Bi_2O_3$, $Co_3O_2$, $MnO_2$, $Sb_2O_3$, $Cr_2O_3$ or NiO, 0.001–0.01 mol % of $Al(NO_3)_3.9H_2O$, 0.01–0.5 mol % of bismuth borosilicate glass containing silver, 0.5–15 mol % of amorphous $SiO_2$ and the rest Of ZnO, is used to produce a voltage non-linear resistor of a diameter of 47 mm and a thickness of 20 mm. In order to examine crystal phases of bismuth oxide and quantity ratio thereof, a voltage of 400 V is used for a variation $V_{ImA/mm}$ after an application of a lightening discharge current, and specimen Nos. 1–16 having crystal phase of $Bi_2O_3$ and quantity ratio within the scope of the present invention, and comparative specimen Nos. 1–12 having either the crystal phases or the quantity ratio outside the scope of the present invention, are prepared. The specimen Nos. 1–6 which are within the scope of the present invention were prepared by adding 7–11 mol % of amorphous silica, sintering at a temperature of 1,050°–1,200° C., and a glass heat-treating at a temperature of 450°–550° C. The specimen Nos. 7–16 which are also within the scope of the present invention were prepared by adding 7–8 mol % of amorphous silica, calcining the raw materials other than ZnO and $Al(NO_3)_3.9H_2O$ at 700°–1,000° C. for 2–8 hrs for preparing the raw materials, sintering at a temperature of 1,050°–1,200° C., and glass heat-treating at a temperature of 450°–550° C. The comparative specimen Nos. 1–3 were prepared at a glass heat-treating temperature different from the above glass heat-treating temperatures. The comparative specimen Nos. 4–12 were prepared at an addition amount of silica different from the above addition amounts of silica. Thus prepared specimens of the present invention and the comparative specimens are measured on voltage non-lineality index α and lightening discharge current withstanding capability. The results are shown on the later-described Table 1.

Crystal phases of bismuth oxide and quantity ratio of the crystal phase are measured by an inner standard method using an X-ray diffraction. In the inner standard method, the peak of 20=23.0° (102) of $CaCO_3$ is used, and quantitative analyzes are effected using $2\theta=26.9°$ (113) for α-$Bi_2O_3$, and 20=30.4° (222) for γ-$Bi_2O_3$.

Voltage non-lineality index α is based on an equation $I=KV^{\alpha}$ (wherein, I is an electric current, V is a voltage, and K is a proportional constant), and measured from a ratio Of $V_{ImA}$ and $V_{100\ \mu A}$. Lightening discharge current withstanding capability test is effected by applying twice an electric current of 60 KA, 65 KA, 70 KA, or 80 KA of a waveform of 4/10 μs, and the element destructed by the test is expressed with a symbol x, and the element non-destructed with a symbol O.

TABLE 1(a)

| Specimen | No. | $Bi_2O_3$ crystal phase | α phase: γ phase (α/γ) | Non-lineality index (α value) | Lightening discharge current withstanding capability (4/10 μs) 60 KA | 65 KA | 70 KA | 80 KA |
|---|---|---|---|---|---|---|---|---|
| Example | 1 | α + γ | 0.12 | 35 | O | O | O | X |
| | 2 | " | 0.18 | 38 | O | O | O | X |
| | 3 | " | 0.21 | 43 | O | O | O | O |
| | 4 | " | 0.25 | 44 | O | O | O | X |
| | 5 | " | 0.33 | 48 | O | O | O | O |
| | 6 | " | 0.37 | 47 | O | O | O | O |
| | 7 | α + γ + δ | 0.41 | 52 | O | O | O | O |
| | 8 | " | 0.44 | 53 | O | O | O | O |
| | 9 | " | 0.49 | 56 | O | O | O | X |
| | 10 | " | 0.53 | 56 | O | O | O | X |
| | 11 | " | 0.59 | 55 | O | O | O | X |
| | 12 | " | 0.63 | 57 | O | O | O | X |
| | 13 | " | 0.66 | 54 | O | O | O | X |
| | 14 | " | 0.72 | 55 | O | O | O | X |
| | 15 | " | 0.77 | 58 | O | O | O | X |
| | 16 | " | 0.80 | 57 | O | O | O | X |
| Comparative Example | 1 | α only | 0 | 42 | O | X | — | — |
| | 2 | β only | 0 | 50 | O | X | — | — |
| | 3 | γ only | 0 | 18 | O | O | O | X |
| | 4 | α + γ | 0.08 | 34 | O | O | X | — |
| | 5 | α + γ + Δ | 0.92 | 56 | O | O | X | — |
| | 6 | α + β + γ | 0.98 | 54 | O | O | X | — |
| | 7 | " | 1.06 | 53 | O | X | — | — |
| | 8 | " | 1.25 | 50 | O | O | X | — |
| | 9 | " | 1.63 | 51 | O | X | — | — |

TABLE 1(a)-continued

| Specimen No. | $Bi_2O_3$ crystal phase | α phase: γ phase (α/γ) | Non-lineality index (α value) | Lightening discharge current withstanding capability (4/10 μs) 60 KA | 65 KA | 70 KA | 80 KA |
|---|---|---|---|---|---|---|---|
| 10 | " | 2.42 | 48 | O | X | — | — |
| 11 | " | 3.01 | 47 | X | — | — | — |
| 12 | " | 5.78 | 41 | X | — | — | — |

As seen clearly from the above Table 1, the specimen Nos. 1–16 which are the voltage non-linear resistor of the present invention have improved voltage non-linearity index α and good lightening discharge current withstanding capability as compared with the comparative specimen Nos. 1–12.

As explained above in detail in the foregoings, the voltage non-linear resistor containing a desired quantity ratio of α type and β type crystal phases as crystal phases of bismuth oxide in the resistor can provide various superior characteristics of resistor, particularly voltage non-lineality index and lightening discharge current withstanding capability of varistor.

Stable characteristics of resistors are also obtained on switching impulse discharge current withstanding capability, life performance against applied voltage, and $V_{ImA}$ variation after application of lightening discharge current, and limit voltage characteristic property.

Although the present invention has been explained with specific examples and numerical values, it is of course apparent to those skilled in the art that various changes and modifications thereof are possible without departing the broad spirit and aspect of the present invention as defined in the appended claims.

What is claimed is:

1. A voltage non-linear sintered resistor, comprising:

zinc oxide, bismuth oxide, and at least one metal oxide additive selected from the group consisting of antimony oxide, silicon oxide, and mixtures thereof; and at least two crystalline phases including α and δ crystalline phases of bismuth oxide;

wherein a quantity ratio of α/δ crystalline phases of bismuth oxide in said sintered resistor is about 0.1–0.8.

* * * * *